US005103069A

United States Patent [19]

Yorita

[11] Patent Number: 5,103,069

[45] Date of Patent: Apr. 7, 1992

[54] ELECTRODE FOR A VACUUM BREAKER

[75] Inventor: Mitsumasa Yorita, Amagasaki, Japan

[73] Assignee: Mitsubishi Denki Kabushiki Kaisha, Tokyo, Japan

[21] Appl. No.: 700,937

[22] Filed: May 13, 1991

Related U.S. Application Data

[63] Continuation of Ser. No. 267,569, Nov. 7, 1988, abandoned.

[30] Foreign Application Priority Data

Nov. 7, 1987 [JP] Japan ..... 62-281694
Nov. 11, 1987 [JP] Japan ..... 62-283117

[51] Int. Cl.[5] ..... H01H 33/66
[52] U.S. Cl. ..... 200/144 B
[58] Field of Search ..... 200/144 B, 279

[56] References Cited

U.S. PATENT DOCUMENTS

| | | | |
|---|---|---|---|
| 3,182,156 | 5/1965 | Lee et al. | 200/144 B |
| 3,280,286 | 10/1966 | Ranheim | 200/144 B |
| 3,683,139 | 8/1972 | Ludwig | 200/144 B |
| 4,324,960 | 4/1982 | Aoki et al. | 200/144 B |
| 4,806,714 | 2/1989 | Aoki | 200/144 B |
| 4,999,463 | 3/1991 | Yin | 200/144 B |

FOREIGN PATENT DOCUMENTS

| | | |
|---|---|---|
| 2429484 | 6/1974 | Fed. Rep. of Germany . |
| 2905087 | 2/1979 | Fed. Rep. of Germany . |
| 2934341 | 8/1979 | Fed. Rep. of Germany . |
| 5530174 | 3/1980 | Japan . |

OTHER PUBLICATIONS

European Search Report; 8-1990.

*Primary Examiner*—J. R. Scott

[57] ABSTRACT

An electrode for a vacuum breaker includes a central flat part having a contact function, peripheral tapered parts having a current-breaking function, and spiral slots formed in the electrode that are inclined with respect to the radial direction. The maximum and minimum widths of the spiral slot L (mm) are given by the formulae:

$$L_{min}(mm)=0.0608(mm/kA)\times I(kA)\times 0.8$$

and $$L_{max}(mm)=0.06[illegible](mm/kA)\times I(kA)\times 1.2$$

where $I=(rated\ circuit\ breaking\ current)\times(1+DC\ component\ fraction)(kA)$.

The width of the spiral slot L is optimized for the required breaking current which makes it possible to further improve the breaking performance. The spiral slot may have a maximum width on the outer circumference of the electrode, which gradually becomes more narrow toward the center, and reaches a minimum width on the inner extremity. By making the slot width L gradually decrease toward the center, a stable operation is possible over a wide range of breaking currents.

18 Claims, 6 Drawing Sheets

ELECTRODE FOR A VACUUM BREAKER

This application is a continuation of application Ser. No. 07/267,569 filed on Nov. 7, 1988, now abandoned.

FIELD OF THE INVENTION

The present invention is directed to a vacuum breaker, and more particularly to an electrode structure having spiral slots which magnetically drive an arc.

BACKGROUND OF THE INVENTION

FIGS. 1A and 1B are a plan view and a profile view (partially respectively of a cross-section) showing an electrode for a conventional vacuum breaker as disclosed in, for example, Japanese Patent Application Laid-Open No. 30174/80.

This electrode includes a generally disk-shaped member having a central flat part 1 with contact function and peripheral tapered parts 2 shaped like the vanes of a windmill for acting as a current-breaking function.

From the flat part 1 to the outer rim of the tapered parts 2, there are several spiral slots 3 extending outwards and inclined at an angle to the radial direction of the electrode.

The electrode further includes an electrode rod 5 connected to the center of the rear surface (lower surface as seen in FIG. 1B) of the disk-shaped member 10.

In the vacuum breaker having the electrodes described above, when a pair of electrodes which have the flat parts 1 in contact, are separated, an arc is set up between the flat parts 1. This arc is driven along to the current path formed by the electrode, and driven outwards along the direction of the electrode. The arc so driven reaches the spiral slot 3, and moves along the spiral slot 3. At this point, the arc is subject to a composite force composed of the circumferential direction force and the radial direction force, and the electrode surface is thereby rotated. When this occurs, the arc rotates over the whole surface of the electrode, and local heating of the electrode does not result.

By increasing the length of the electrode in the circumferential direction, or the diameter of the electrode, the area over which the current flows is increased so that the current-breaking capacity of the vacuum breaker will be increased. The width or shape of the spiral slot 3 may also affect the current-breaking capacity. In the reference mentioned above, it is noted that for vacuum breakers having a current rating of 8 KA or more, the width of the spiral slot should be at least 1.5 mm.

In conventional vacuum breakers of the above described type, however, it was found that the breaking capacity did not increase linearly with the diameter of the electrode. This was a major obstacle which prevented vacuum breakers from becoming more compact.

SUMMARY OF THE INVENTION

The present invention is directed to solving the above described problems. The breaking performance is improved without increasing the diameter of the electrode, and an electrode is provided for a vacuum breaker with stable breaking performance over all ranges of the breaking current.

In an electrode for a vacuum breaker in an embodiment of the present invention, the maximum and minimum widths of the spiral slot L (mm) of the electrode are calculated by the formulae;

$$L_{min}(\text{mm}) = 0.0608(\text{mm}/kA) \times I(kA) \times 0.8$$

and $$L_{max}(\text{mm}) = 0.0608(\text{mm}/kA) \times I(kA) \times 1.2$$

where I=(rated breaking current)×(1+D.C. component fraction) (KA).

In another embodiment of the present invention, a spiral slot has a maximum width $L_{max}$ on the outer circumference of the electrode, and gradually becomes more narrow toward the center, before reaching a minimum width $L_{min}$ on the final edge.

The width of the spiral slot of the electrode is optimized for the required breaking current, and it is thus possible to further improve the breaking performance using conventional electrode diameters.

Additionally, by gradually decreasing the spiral slot width toward the center, stable operation is possible over a wide range of breaking currents.

BRIEF DESCRIPTION OF DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

The preferred embodiments of the electrode for a vacuum breaker according to the present invention will be described with reference to the figures.

Figure 2A:
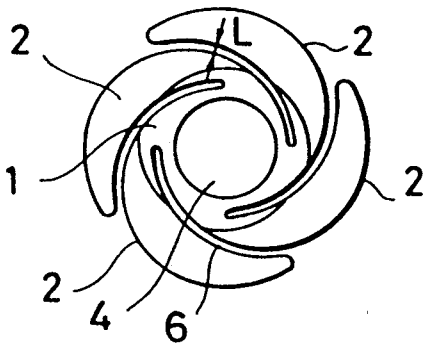
FIGS. 2A and 2B are plan and profile views of an electrode in the vacuum breaker of an embodiment of the present invention.
Figure 2B:
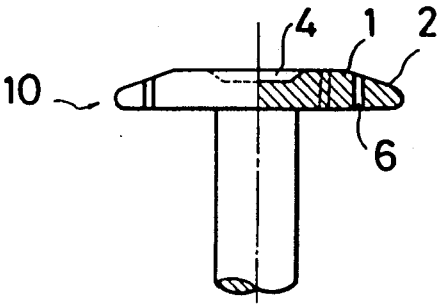
Figure 1A:
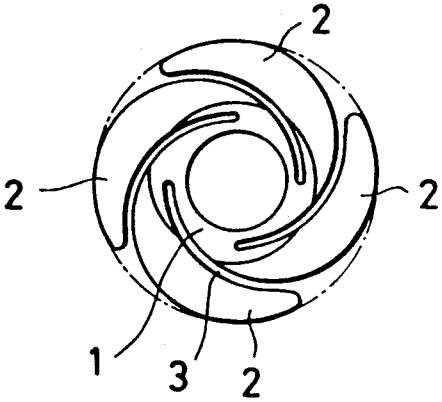
FIG. 1A PRIOR ART
FIGS. 1A and 1B are plan and profile views showing the electrode structure of a conventional vacuum breaker.
Figure 1B:
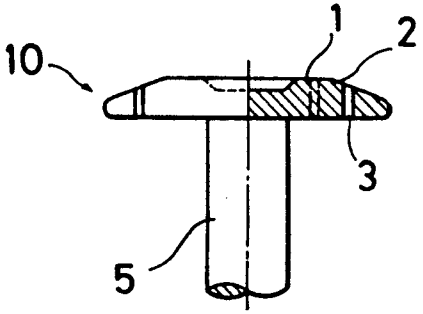
FIG. 1B PRIOR ART

FIGS. 2A and 2B show one embodiment of the electrode for the vacuum breaker of the present invention. As illustrated, the electrode includes a generally disk-shaped member 10 having a flat part 1 with a contact function and a recess 4 in the center. The disk-shaped member 10 further includes tapered parts 2 with a breaking function. Several elongated cuts 6 extend along spiral lines centered on the center of the disk-shaped member 10. In the embodiment illustrated in FIGS. 2A and 2B, the spiral slots are circular arcs. The elongated cuts are hereinafter called spiral slots. The spiral slots 6 extend, at any part thereof, at an angle to the radial direction of the electrode from the flat part 1 to the outer circumference of the tapered parts 2.

In the vacuum breaker having the electrodes described above, when a pair of electrodes, which have the flat parts 1 in contact are separated, an arc is set up between them. This arc then rotates over the electrode surface along the spiral slot 6 in the flat part 1 and the tapered parts 2.

When the rotation speed of this arc was observed by an optical device with a high speed camera, it was found that the speed was closely related to the width L of the spiral slot 6 of the electrode. If the width L is too small, the arc jumps over the spiral slot 6 easily, and the force which rotates the arc in the circumferential direction is not strong enough. If on the other hand the width L is too large, the arc takes too long to jump over the spiral slot 6. In both cases, the rotational speed of the arc is too slow. Because the magnitude of the speed was related to performance, it was thus established that the width L of the spiral slot 6 has an optimum value.

Figure 3:
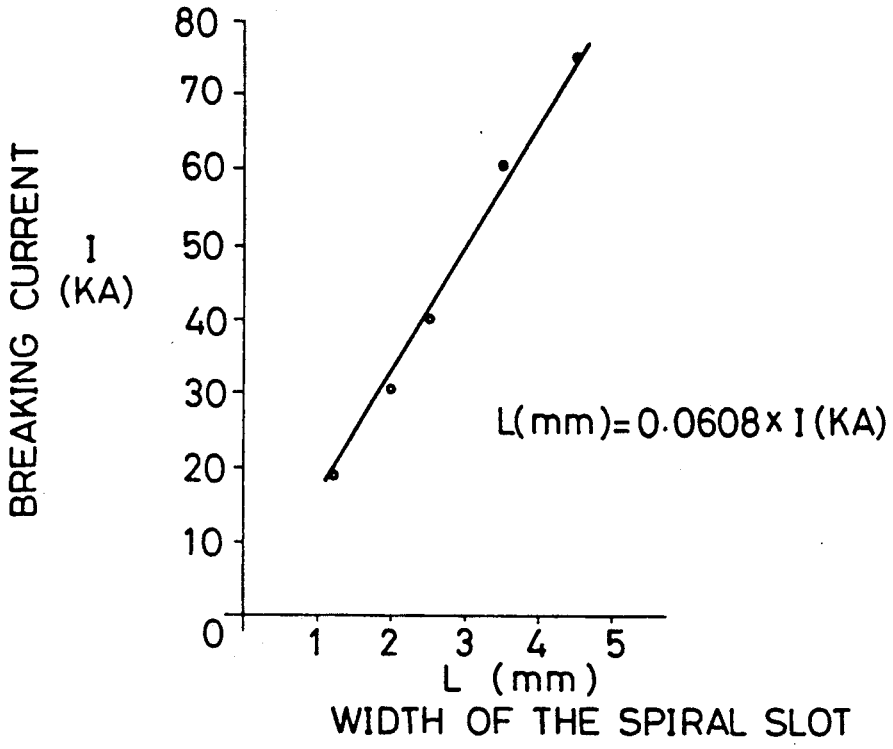
FIG. 3 is a diagram showing the relation of the width of the spiral slot of the electrode to the maximum circuit-breaking current.

The maximum performance for various spiral slot widths L was measured, and the relation between the spiral slot width and the breaking current was obtained as shown in FIG. 3. From FIG. 3, it was found that the optimum value of the width L of the spiral slot 6 for different values of breaking current is given by:

$$L(\text{mm})=0.0608(\text{mm}/kA)\times I(kA)$$

where I is the rated breaking current (KA) multiplied by the factor (1+D.C. component fraction).

Figure 4:
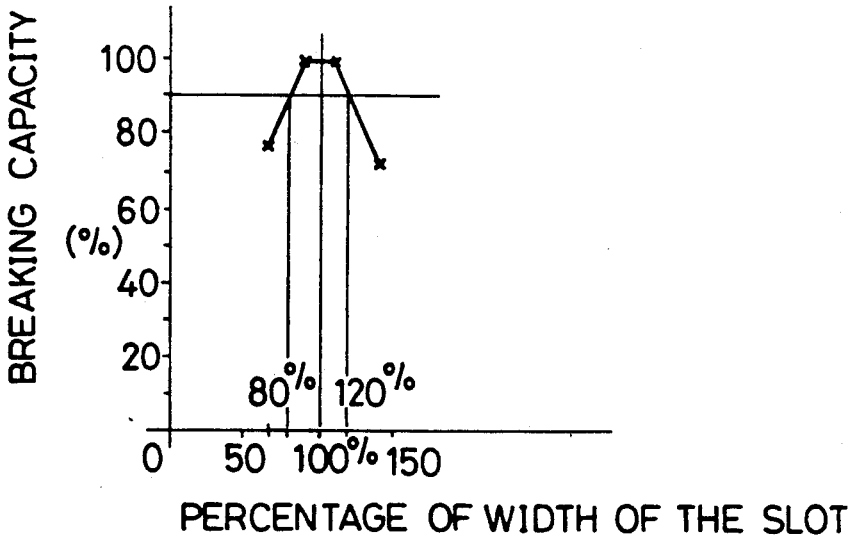
FIG. 4 is a diagram showing the relation between the deviation from the optimum value of spiral slot width of the electrode, and the breaking performance.
Figure 6A:
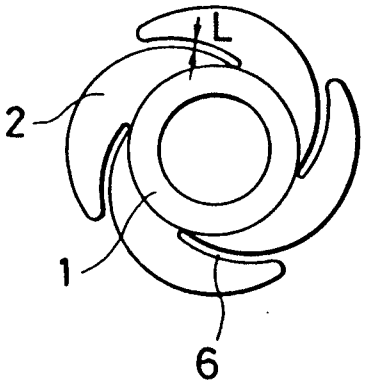
FIGS. 5A, 5B, 6A, 6B, 7A and 7B are modified versions of FIGS. 1A and 1B respectively.
Figure 6B:
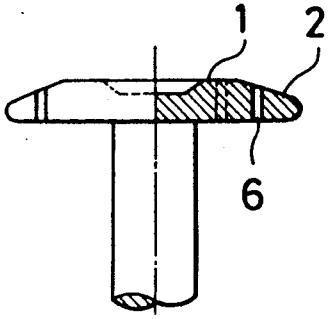

The variation of performance was examined with respect to variation of the spiral slot width L. From FIG. 3, for example, a spiral slot width of 2.5 mm was taken as optimum for a maximum breaking current of 40 KA. Various electrodes with spiral slot widths differing from this width by ±10%, −35% and +40% were fabricated, and the maximum breaking current was measured. FIG. 4 illustrates the results of this measurement. It was found from FIG. 4 that for electrodes with a spiral slot width differing by no more than ±10% from the reference optimum width, the performance was not affected. However when the difference was −35% or +40%, the performance declined.

The electrode should therefore have spiral slots of a dimension and a shape which give the best breaking performance in accordance to the breaking current. Further, any deviation from this optimum value should be within such limits which ensure that the electrode provides approximately 90% of its ideal performance. From FIG. 4, it was found that the lower limit for the width was 80% of the optimum value, and the upper limit was 120% of this value.

The minimum value of the width of the spiral slot 6 is therefore given by:

$$L_{min}=0.0608\times I\times 0.8 \qquad \text{(Eqn. 1).}$$

The maximum value of the width of the spiral slot 6 is given by:

$$L_{max}=0.0608\times I\times 1.2 \qquad \text{(Eqn. 2)}$$

The permissible values of the spiral slot width lie within the minimum and maximum values $L_{min}$ and $L_{max}$ as given by Equations 1 and 2.

For a vacuum breaker having a rated breaking current of 25 KA and a D.C. component fraction of 0.5, the minimum width $L_{min}$ of the spiral slot 6 is:

$$L_{min}=0.0608\times 25\times(1+0.5)\times 0.8=1.824 \text{ mm}$$

The maximum width $L_{max}$ is:

$$L_{max}=0.0608\times 25\times(1+0.5)\times 1.2=2.736 \text{ mm.}$$

The D.C. component fraction lies in the range of 0~1.

Figure 5A:
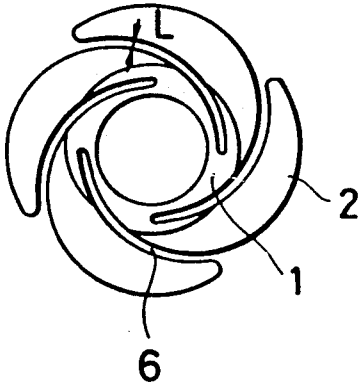
Figure 5B:
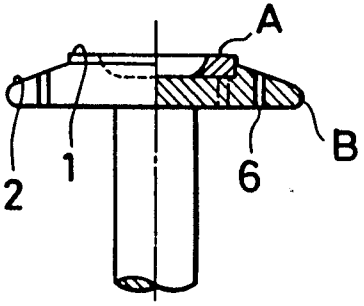

In the above embodiment, the flat part 1 and tapered parts 2 are made of the same material. However, these parts may be made of different materials. As in FIGS. 5A and 5B, for example, the flat part 1 may be made of a contact material A having a high breakdown voltage with a low surge. The tapered parts 2 may be made of a circuit breaking contact material B having a high current rating.

In the above embodiment, the spiral slots 6 extend from the tapered parts 2 to the flat parts 1. Alternatively, the spiral slots 6 may be present only on the tapered parts 2, as illustrated in FIGS. 6A, 6B, 7A and 7B.

By optimizing the width of the spiral slot in the flat part 1 and the tapered parts 2, or in the tapered parts 2 alone, which drive the arc depending on the breaking current, the breaking capacity may be increased and a more compact vacuum breaker can be obtained.

Although the width of the spiral slot can thus be optimized for the breaking current as described above, it is generally recognized that the vacuum breaker can perform not only at one current value but also at other current values. In other words, a vacuum breaker having a certain current rating must nevertheless be able to break the circuit at lesser current values, and must have a stable operation over the whole range of breaking currents. In order for the circuit to cope with the full range of breaking currents, it is desirable to form the width of the spiral slot with a gradual variation. More specifically, the width of the slot should decrease gradually toward the inner extremity. If, for instant, a breaker having a current rating of 25 KA is required to operate effectively at 10 KA, the slot should have a width $L_{min}$ given below:

$$L_{min}=0.0608\times 10\times 0.8=0.4864 \text{ (mm).}$$

Figure 8A:
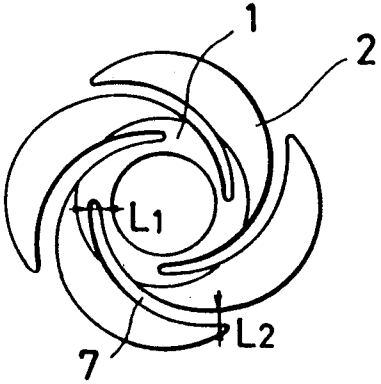
FIGS. 8A and 8B are plan and profile views of the electrode structure of an electrode for a vacuum breaker in another embodiment of the present invention.
Figure 8B:
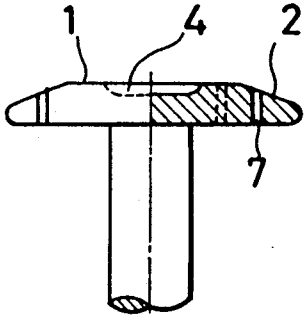
Figure 7A:
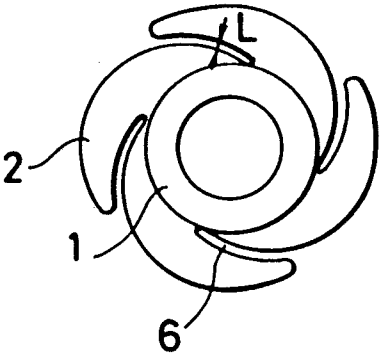
Figure 7B:
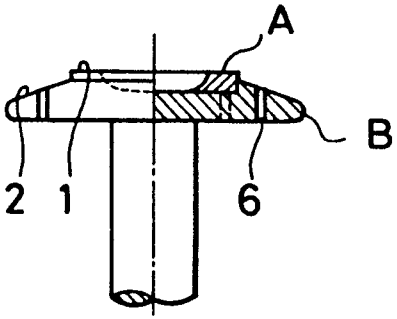

As shown in FIGS. 8A and 8B, if the width $L_1$ of the spiral slot 7 in the flat part 1 and the tapered parts 2 in the center of the electrode is $L_{min}$, which become wider towards the outside of the electrode, and the width $L_2$ on the edge of the electrode is $L_{max}$ (=2.7 mm for the 25 KA grade device described above), the electrode will have a stable breaking performance over the whole range of breaking currents.

In this embodiment of the invention, several spiral slots 7 were provided with widths ranging continuously from 0.5 mm or more to the optimum value for the breaking current. The rotational speed of the arc can thus be increased, and the breaking performance of the electrode can be further improved, and stabilized over the whole range of breaking currents.

Figure 9A:
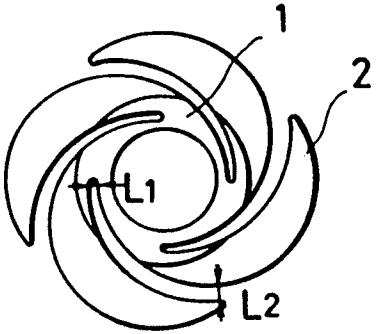
Figure 9B:
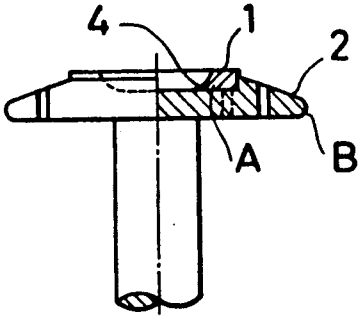

In the embodiment of FIGS. 8A and 8B, the flat part 1 and the tapered parts 2 are made of the same material. However, the parts may be made of different materials. For example, in FIGS. 9A and 9B, the flat part 1 may be made of an electrode material having a high breakdown voltage and a low surge electrode material, while the tapered parts 2 may be made of a material having a high breaking performance.

Figure 10A:
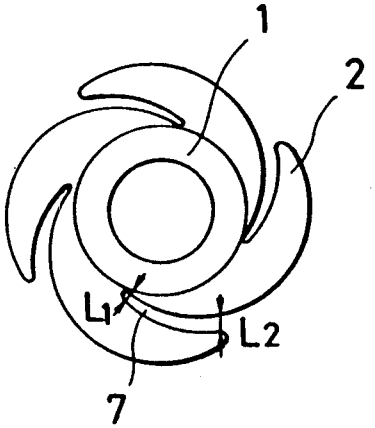
FIGS. 9A, 9B, 10A, 10B, 11A and 11B are modified versions of FIGS. 8A and 8B.
Figure 10B:
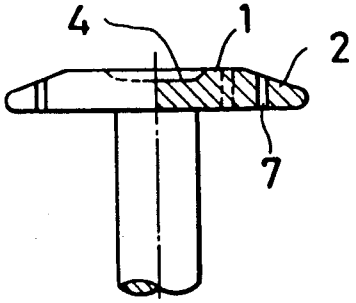
Figure 11A:
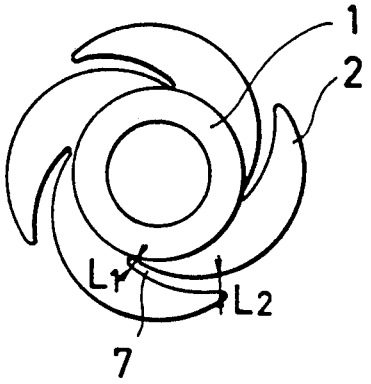
Figure 11B:
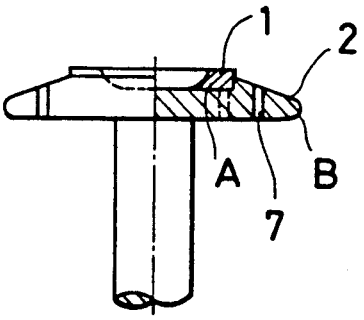

Also, the spiral slot 7 may be provided only in the tapered parts 2 of an electrode wherein the flat part 1 and the tapered parts 2 are made of the same material as in FIGS. 10A and 10B, or of an electrode made of different materials as in FIGS. 11A and 11B.

Thus, by providing the electrode with a spiral slot which drives the arc magnetically, and of which the dimensions are optimized for the required breaking current, as shown in FIGS. 9A and 9B to FIGS. 11A and 11B, the current-breaking performance can be improved, and stabilized over a wide range of breaking currents.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrode for a vacuum breaker comprising:

a generally disk-shaped member connected with the electrode including, a central flat portion for providing a contacting function, a plurality of peripheral tapered portions connected to said central flat portion for providing a current-breaking function, and a plurality of spiral slots formed in said disk-shaped member and extended at an angle with respect to the radial direction of said disk-shaped member;

wherein the width of said spiral slots is calculated by the formula, $$L(\text{mm}) = 0.0608(\text{mm}/kA) \times I(kA) \times k$$

where I = x (1 + the DC Component fraction) in kA, 0.8 $\leqq$ k $\leqq$ 1.2 in dimensionless units and L = the width in mm.

2. An electrode for a vacuum breaker as set forth in claim 1, wherein each of said plurality of spiral slots comprises the same dimension and shape.

3. An electrode for a vacuum breaker as set forth in claim 1, wherein said plurality of spiral slots are formed only in said peripheral tapered portions.

4. An electrode for a vacuum breaker as set forth in claim 1, wherein said central flat portion and said plurality of peripheral tapered portions comprise the same material.

5. An electrode for a vacuum breaker as set forth in claim 1, wherein said central flat portion comprises a first material and said plurality of peripheral tapered portions comprise a second material different from said first material.

6. An electrode for a vacuum breaker as set forth in claim 3, wherein said central flat portion comprises a first material and said plurality of peripheral tapered portions comprise a second material different from said first material.

7. An electrode for a vacuum breaker comprising:

a generally disk-shaped member connected with the electrode including, a central flat portion for providing a contacting function, a plurality of peripheral tapered portions connected to said central flat portion for providing a current-breaking function, and a plurality of spiral slots formed in said disk-shaped member and extended at an angle with respect to the radial direction of said disk-shaped member;

wherein the width of said spiral slots is calculated by the formula, $$L(\text{mm}) = 0.0608(\text{mm}/kA) \times I(kA) \times k$$

where I = x (1 + the DC component fraction) in kA, 0.8 $\leqq$ k $\leqq$ 1.2 in dimensionless units and L = the width in mm and the width of said spiral slot a maximum width at the outer edge of said peripheral tapered portions and the width gradually decreases until a minimum value is reached at the center of the electrode.

8. An electrode for a vacuum breaker as set forth in claim 7, said minimum values of said spiral slots conforms to the condition:

$$L_{min}\ 0.5\ (\text{mm.}).$$

9. An electrode for a vacuum breaker as set forth in claim 7, wherein said plurality of spiral slots comprise the same dimension and shape.

10. An electrode for a vacuum breaker as set forth in claim 7, wherein said plurality of spiral slots are formed only in said peripheral tapered portions.

11. An electrode for a vacuum breaker as set forth in claim 7, wherein said central flat portion and said plurality of peripheral tapered portions comprise the same material.

12. An electrode for a vacuum breaker as set forth in claim 7, wherein said central flat portion comprises a first material and said plurality of peripheral tapered portions comprise a second material different from said first material.

13. An electrode for a vacuum breaker as set forth in claim 7, wherein said central flat portion comprises a first material and said plurality of peripheral tapered portions comprise a second material different from said first material.

14. An electrode for a vacuum breaker as set forth in claim 5, wherein said first material comprises a high breakdown voltage and a low surge electrode material and said second material comprises a high breaking performance material.

15. An electrode for a vacuum breaker as set forth in claim 6, wherein said first material comprises a high breakdown voltage and a low surge electrode material and said second material comprises a high breaking performance material.

16. An electrode for a vacuum breaker as set forth in claim 12, wherein said first material comprises a high breakdown voltage and a low surge electrode material and said second material comprises a high breaking performance material.

17. An electrode for a vacuum breaker as set forth in claim 13, wherein said first material comprises a high breakdown voltage and a low surge electrode material and said second material comprises a high breaking performance material.

18. An electrode for a vacuum breaker as set forth in claim 7, wherein said minimum value of the width is calculated by the formula when k = 0.8 and said maximum value of the width is calculated by the formula when k = 1.2.

* * * * *